US010909964B2

(12) United States Patent
Bhimavarapu et al.

(10) Patent No.: US 10,909,964 B2
(45) Date of Patent: Feb. 2, 2021

(54) PERSON SUPPORT APPARATUSES WITH NOISE CANCELLATION

(71) Applicant: Stryker Corporation, Kalamazoo, MI (US)

(72) Inventors: Krishna Sandeep Bhimavarapu, Kalamazoo, MI (US); Christopher Ryan Sweeney, Portage, MI (US); William Dwight Childs, Plainwell, MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 16/453,587

(22) Filed: Jun. 26, 2019

(65) Prior Publication Data

US 2019/0318718 A1 Oct. 17, 2019

Related U.S. Application Data

(63) Continuation of application No. 15/800,316, filed on Nov. 1, 2017, now Pat. No. 10,339,911.
(Continued)

(51) Int. Cl.
*G10K 11/16* (2006.01)
*H04R 3/00* (2006.01)
(Continued)

(52) U.S. Cl.
CPC ..... *G10K 11/178* (2013.01); *G10K 11/17837* (2018.01); *H04R 1/028* (2013.01);
(Continued)

(58) Field of Classification Search
CPC ..... H04R 1/02; H04R 1/028; H04R 1/1008; H04R 1/1041; H04R 3/00; H04R 3/005;
(Continued)

(56) References Cited

U.S. PATENT DOCUMENTS

2003/0002590 A1* 1/2003 Kaku ..... H04B 1/123 375/285
2004/0189475 A1* 9/2004 Cooper ..... A61B 5/1118 340/573.1
(Continued)

*Primary Examiner* — Thang V Tran
(74) *Attorney, Agent, or Firm* — Warner Norcross + Judd LLP

(57) ABSTRACT

A person support apparatus, such as a bed, cot, stretcher, or the like, includes an active noise cancellation device configured to generate a noise cancelling sound wave that is designed to cancel a noise sound wave. The active noise cancellation device may include speakers and a microphone. In other embodiments, the person support apparatus includes a sound emitting component and a transmitter adapted to send out a notification signal prior to activation of the sound emitting component. The notification signal provides information about a characteristic of the sound to be emitted by the sound emitting device. The recipient of the notification signal may then use the signal to cancel the sound that is to be emitted. In some embodiments, the person support apparatus acts as a conduit for notification signals of upcoming sounds, receiving and forwarding such notification signals from and to other devices.

19 Claims, 7 Drawing Sheets

Related U.S. Application Data

(60) Provisional application No. 62/415,563, filed on Nov. 1, 2016.

(51) Int. Cl.
*G10K 11/178* (2006.01)
*H04R 1/02* (2006.01)
*H04R 1/10* (2006.01)

(52) U.S. Cl.
CPC ..... *H04R 3/00* (2013.01); *G10K 2210/108* (2013.01); *G10K 2210/1081* (2013.01); *G10K 2210/3011* (2013.01); *G10K 2210/3044* (2013.01); *H04R 1/1008* (2013.01); *H04R 1/1041* (2013.01); *H04R 2400/00* (2013.01); *H04R 2410/05* (2013.01); *H04R 2420/05* (2013.01); *H04R 2460/01* (2013.01)

(58) Field of Classification Search
CPC .. H04R 3/12; H04R 2400/00; H04R 2410/05; H04R 2420/05; H04R 2460/01; G10K 11/16; G10K 11/178; G10K 11/1783; G10K 11/17837; G10K 2210/1081; G10K 2210/3011; G10K 2210/3044
See application file for complete search history.

(56) References Cited

U.S. PATENT DOCUMENTS

2004/0234080 A1* 11/2004 Hernandez ..... G10K 11/17823 381/71.11
2008/0110459 A1* 5/2008 Farbarik ..... A61M 16/0051 128/204.18
2009/0016545 A1* 1/2009 Stelliga ..... H04B 15/00 381/94.3
2009/0147965 A1* 6/2009 Kuo ..... G10K 11/002 381/71.6
2011/0185499 A1* 8/2011 Richards ..... G10K 11/178 5/425
2012/0029386 A1* 2/2012 Ward ..... A61B 7/00 600/586
2016/0093281 A1* 3/2016 Kuo ..... A61G 11/00 381/71.1

* cited by examiner

PERSON SUPPORT APPARATUSES WITH NOISE CANCELLATION

CROSS-REFERENCE TO RELATED APPLICATIONS

This application claims priority to U.S. patent application Ser. No. 15/800,316 filed Nov. 1, 2017, by inventors Krishna Bhimavarapu et al. and entitled PERSON SUPPORT APPARATUSES WITH NOISE CANCELLATION, which in turn claims priority to U.S. provisional patent application Ser. No. 62/415,563 filed Nov. 1, 2016, by inventors Krishna Bhimavarapu et al. and entitled PERSON SUPPORT APPARATUSES WITH NOISE CANCELLATION, the complete disclosures of both of which are incorporated herein by reference.

BACKGROUND

The present disclosure relates to person support apparatuses, such as beds, cots, stretchers, operating tables, recliners, or the like. More specifically, the present disclosure relates to person support apparatuses that are adapted to reduce ambient noises for occupants of the person support apparatus.

Existing hospitals and healthcare facilities are environments where noise is common. Such noise comes from a variety of sources, including, but not limited to, equipment, alarms and alerts, motors, speakers, heating and cooling systems, and the like. Such noises tend to degrade the quality of the occupant's time at the hospital or healthcare facility.

SUMMARY

According to various embodiments, an improved person support apparatus is provided having one or more features adapted to reduce at least some of the ambient noises that an occupant of the person support apparatus might otherwise experience. In some embodiments, an active noise cancellation device is included in the person support apparatus that actively cancels certain noises in one or more regions of the person support apparatus. The cancelled noise may be unpredictable ambient noise or noise with one or more predictable characteristics, such as alarms or alerts. In some embodiments, active noise cancellation is provided through headphones coupled to a headphone jack on the person support apparatus. Direct communication between the person support apparatuses and/or other medical devices occurs in some embodiments whereby notification signals or messages are shared regarding upcoming alarms, or other audible signals. Such advance notification allows neighboring person support apparatuses to prepare noise cancelling sound waves and, in some cases, determine the phase at which the upcoming sound waves will arrive at the person support apparatus prior to the actual arrival of the sound waves.

According to one embodiment of the present disclosure, a person support apparatus is provided that includes a support surface and an active noise cancellation device. The support surface is adapted to support thereon an occupant of the person support apparatus. The active noise cancellation device is configured to generate a noise cancelling sound wave that is adapted to cancel a noise sound wave.

According to another embodiment of the present disclosure, a person support apparatus is provided that includes a support surface, a sound emitting component, and a transmitter. The support surface is adapted to support thereon an occupant of the person support apparatus. The sound emitting component emits one or more sounds, whether intentionally (e.g. an alarm) or as a byproduct of performing another function (e.g. a motor). The transmitter sends out a notification signal prior to activation of the sound emitting component. The notification signal provides information about a characteristic of the sound to be emitted by the sound emitting device.

According to still another embodiment of the present disclosure, a person support apparatus is provided that includes a support surface, a receiver, and a transmitter. The support surface is adapted to support thereon an occupant of the person support apparatus. The receiver is adapted to receive a first notification signal from a first device regarding an upcoming noise sound wave. The transmitter is adapted to send out a second notification signal to a second device regarding the upcoming noise sound wave. Either or both of the first and second devices may be separate person support apparatuses positioned within aural communication range of the person support apparatus, or either or both of them may be other types of devices positioned within aural communication range of the person support apparatus.

According to other aspects, the support surface comprises a head end and a foot end and the noise cancelling sound wave is generated so as to cancel the noise sound wave in a region adjacent the head end of the support surface.

The noise cancellation device may include a first speaker positioned adjacent a right side of the head end and a second speaker positioned adjacent a left side of the head end. The active noise cancellation device uses the first and second speakers to generate the noise cancelling sound wave.

In some embodiments, a headphone jack is included that is adapted to receive a set of headphones. The active noise cancellation device generates the noise cancelling sound wave in the set of headphones when the set of headphones are plugged into the headphone jack.

The active noise cancellation device, in some embodiments, includes one or more microphones adapted to detect the noise sound wave prior to the noise sound wave reaching an occupant of the person support apparatus. The controller may gather phase information and amplitude information from the detected noise sound wave. In some embodiments, the person support apparatus includes a memory in which pitch information regarding the noise sound wave is stored prior to the noise sound wave being detected by the microphone(s). The active noise cancellation device generates the noise cancelling sound wave based upon the phase information, the amplitude information, and the stored pitch information.

In some embodiments, the active noise cancellation device only generates a noise cancelling sound wave for noise sound waves meeting a predefined set of criteria. In other embodiments, the active noise cancellation device generates noise cancelling sound waves for all detected noise sound waves.

When cancelling noise sound waves that meet a predefined set of criteria, the predefined set of criteria may include one or more of the following: noise sound waves emanating from a motor onboard the person support apparatus, noise sound waves emanating from an alarm onboard the person support apparatus, and noise sound waves emanating from an alarm positioned off board the person support apparatus.

The active noise cancellation device is adapted to receive a notification signal prior to generation of the noise sound wave, in some embodiments. The active noise cancellation device uses the notification signal to generate a noise cancellation sound wave at the appropriate time and/or with the appropriate amplitudes and frequencies. The notification signal may come from a component onboard the person support apparatus or from a device off board the person support apparatus.

The notification signal includes information about a characteristic of the noise sound wave. The characteristic may include any one or more of the following: a pitch of the noise sound wave, a duration of the noise sound wave, an amplitude of the noise sound wave, a phase of the noise sound wave, and/or a length of a time interval between repetitions of the noise sound wave.

The notification signal is transmitted ultrasonically in some embodiments and electromagnetically in other embodiments. In still other embodiments, the notification signal is transmitted both ultrasonically and electromagnetically.

An occupant detection subsystem in included in some of the person support apparatus embodiments. The occupant detection subsystem detects the presence or absence of an occupant in the person support apparatus. The active noise cancellation device does not generate the noise cancelling sound wave if the occupant detection subsystem determines that the person support apparatus is unoccupied.

According to still other aspects, the transmitter may be adapted to transmit the notification signal electromagnetically, ultrasonically, or by a combination of both electromagnetic and ultrasonic signals to a receiving device. The receiving device may be on board and/or off board the person support apparatus. When off-board, it may be another person support apparatus, or it may be a non-person support apparatus device. In some embodiments, a second transmitter is included that is adapted to transmit a second notification signal to an active noise cancellation device positioned on board the person support apparatus having the second transmitter.

In some embodiments, the active noise cancellation device generates noise cancelling sound waves only for noise sound waves for which a first notification signal is received.

The active noise cancellation device may be configured so as to deliberately not generate a noise cancelling sound wave for certain noises. For example, a controller associated with the active noise cancellation device may first determine if an ambient sound wave is associated with at least one of the following: a fire alarm, a smoke alarm, and a weather emergency alarm. If so, the active noise cancellation device does not generate a noise cancelling sound wave directed to those noises.

Before the various embodiments disclosed herein are explained in detail, it is to be understood that the claims are not to be limited to the details of operation or to the details of construction and the arrangement of the components set forth in the following description or illustrated in the drawings. The embodiments described herein are capable of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the claims to any specific order or number of components. Nor should the use of enumeration be construed as excluding from the scope of the claims any additional steps or components that might be combined with or into the enumerated steps or components.

DETAILED DESCRIPTION OF THE EMBODIMENTS

Figure 1:
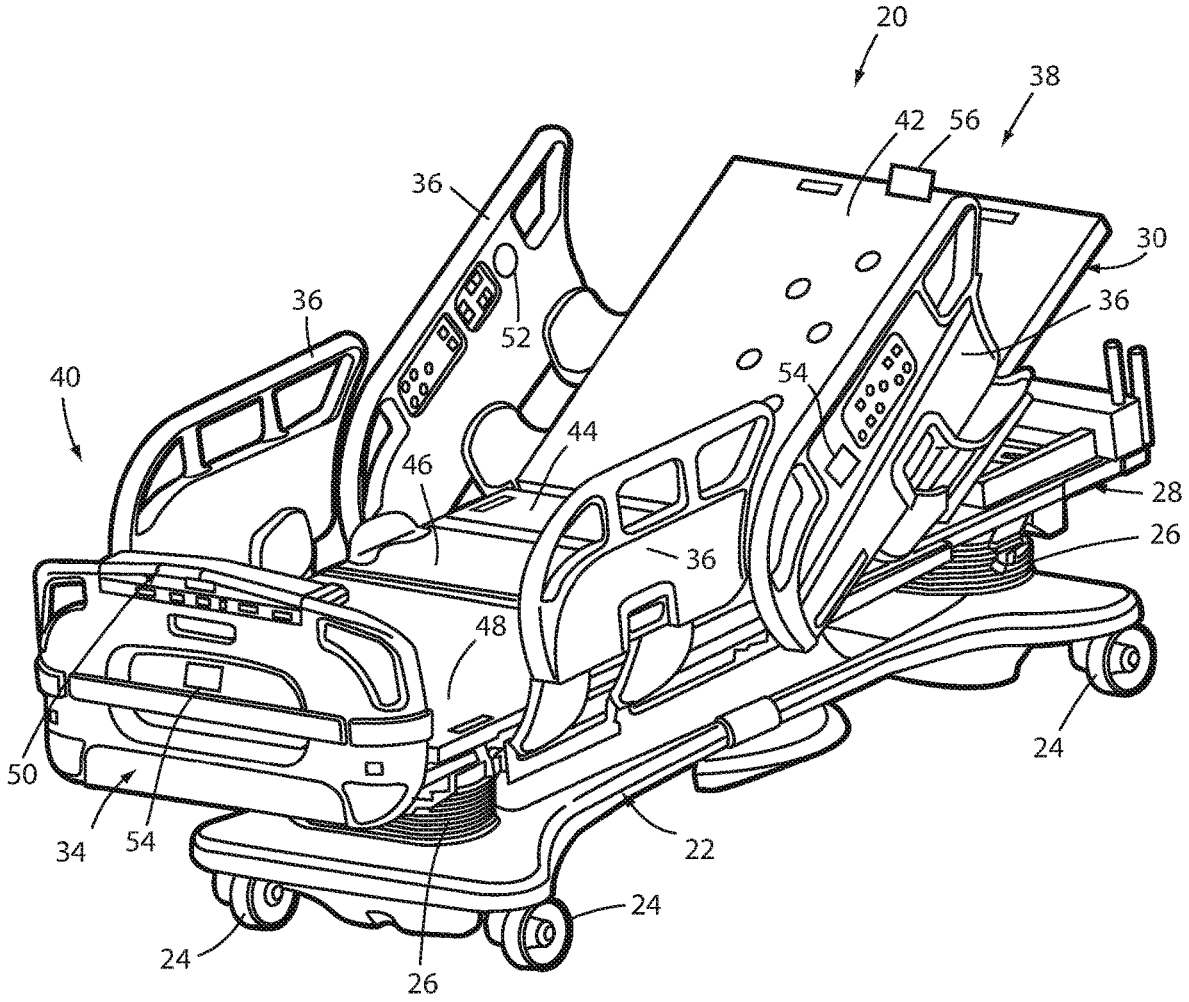
FIG. 1 is a perspective view of a person support apparatus according to one embodiment of the disclosure.

An illustrative person support apparatus 20 that incorporates various aspects of the present disclosure is shown in FIG. 1. Although the particular form of person support apparatus 20 illustrated in FIG. 1 is a bed adapted for use in a hospital or other medical setting, it will be understood that person support apparatus 20 could, in different embodiments, be a cot, a stretcher, a gurney, a recliner, an operating table, a residential bed, or any other structure capable of supporting a person, whether stationary or mobile and/or whether medical or residential.

In general, person support apparatus 20 includes a base 22 having a plurality of wheels 24, a pair of lifts 26 supported on the base, a litter frame 28 supported on the lifts 26, and a support deck 30 supported on the litter frame 28. Person support apparatus 20 further includes a headboard (not shown), a footboard 34, and a plurality of siderails 36. Siderails 36 are all shown in a raised position in FIG. 1 but are each individually movable to a lower position in which ingress into, and egress out of, person support apparatus 20 is not obstructed by the lowered siderails 36.

Lifts 26 are adapted to raise and lower litter frame 28 with respect to base 22. Lifts 26 may be hydraulic actuators, electric actuators, or any other suitable device for raising and lowering litter frame 28 with respect to base 22. In the illustrated embodiment, lifts 26 are operable independently so that the tilting of litter frame 28 with respect to base 22 can also be adjusted. That is, litter frame 28 includes a head end 38 and a foot end 40, each of whose height can be independently adjusted by the nearest lift 26. Person support apparatus 20 is designed so that when an occupant lies thereon, his or her head will be positioned adjacent head end 38 and his or her feet will be positioned adjacent foot end 40.

Litter frame 28 provides a structure for supporting support deck 30, the headboard, footboard 34, and siderails 36. Support deck 30 provides a support surface for a mattress (not shown in FIG. 1), or other soft cushion, so that a person may lie and/or sit thereon. The top surface of the mattress or other cushion forms a support surface for the occupant. Support deck 30 is made of a plurality of sections, some of which are pivotable about generally horizontal pivot axes. In the embodiment shown in FIG. 1, support deck 30 includes a head section 42, a seat section 44, a thigh section 46, and a foot section 48. Head section 42, which is also sometimes referred to as a Fowler section, is pivotable about a generally horizontal pivot axis between a generally horizontal orientation (not shown in FIG. 1) and a plurality of raised positions (one of which is shown in FIG. 1). Thigh section 46 and foot section 48 may also be pivotable about generally horizontal pivot axes.

Litter frame 28 is supported by two lift header assemblies (not shown) positioned on top of lifts 26. Each lift header assembly includes a pair of force sensors, which may be load cells, or other types of force sensors, such as, but not limited to, linear variable displacement transducers and/or any one or more capacitive, inductive, and/or resistive transducers that are configured to produce a changing output in response to changes in the force exerted against them. The force sensors are adapted to detect the weight of not only those components of person support apparatus 20 that are supported by litter frame 28 (including litter frame 28 itself), but also any objects or persons who are wholly or partially being supported by support deck 30. As will be discussed in greater detail below, these force sensors may be part of an occupant detection subsystem of person support apparatus 20. Alternatively, or additionally, these force sensors may be used as part of a scale and/or exit detection system.

The mechanical construction of person support apparatus 20 may be the same as or similar to the mechanical construction of the Model 3002 S3 bed manufactured and sold by Stryker Corporation of Kalamazoo, Mich. This mechanical construction is described in greater detail in the Stryker Maintenance Manual for the MedSurg Bed, Model 3002 S3, published in 2010 by Stryker Corporation of Kalamazoo, Mich., the complete disclosure of which is incorporated herein by reference. It will be understood by those skilled in the art that person support apparatus 20 can be designed with other types of mechanical constructions, such as, but not limited to, those described in commonly assigned, U.S. Pat. No. 7,690,059 issued to Lemire et al., and entitled HOSPITAL BED; and/or commonly assigned U.S. Pat. publication No. 2007/0163045 filed by Becker et al. and entitled PATIENT HANDLING DEVICE INCLUDING LOCAL STATUS INDICATION, ONE-TOUCH FOWLER ANGLE ADJUSTMENT, AND POWER-ON ALARM CONFIGURATION, the complete disclosures of both of which are also hereby incorporated herein by reference. The mechanical construction of person support apparatus 20 may also take on forms different from what is disclosed in the aforementioned references.

Person support apparatus 20 further includes a user interface 50 that enables a user of person support apparatus 20 to control one or more aspects of person support apparatus 20, including, but not limited to, an active noise cancellation device discussed in more detail below. User interface 50 is implemented in the embodiment shown in FIG. 1 as a control panel having a lid (flipped down in FIG. 1) underneath which is positioned a plurality of controls. The controls may be implemented as buttons, dials, switches, or other devices. User interface 50 may also include a display for displaying information regarding person support apparatus 20. Although FIG. 1 illustrates user interface 50 mounted to footboard 34, it will be understood that user interface 50 can be positioned elsewhere, and/or that one or more additional user interfaces can be added to person support apparatus 20 in different locations, such as the siderails 36, for controlling various aspects of person support apparatus 20.

Person support apparatus 20 further includes a pair (or more) of speakers 52. As shown in FIG. 1, a first one of the speakers 52 is mounted to an inside surface of the right head end siderail 36 and faces toward the occupant's head. A second one of the speaker 52 (not visible in FIG. 1) is mounted in a similar location on the inside surface of the left head end siderail 36 and also faces toward the occupant's head. In some embodiments, one or more additional speakers 52 may be included. In still other embodiments, only a single speaker 52 is included. Further, in some embodiments, the locations of one or more of the speakers 52 may be changed from what is illustrated in FIG. 1.

Person support apparatus 20 also includes a plurality of microphones 54. In the embodiment shown in FIG. 1, person support apparatus 20 includes three microphones 54: a first one mounted to footboard 34, a second one mounted to an outside surface of left head end siderail 36, and a third one (not visible) mounted to an outside surface of right head end siderail 36. As with speakers 52, the location and number of microphones 54 may be changed from what is shown in FIG. 1.

Person support apparatus 20 further includes a feedback microphone 56 mounted at the head end 38 of Fowler section 42. In the embodiment shown, feedback microphone 56 is mounted generally in the middle between the right and left sides of Fowler section 42. The precise location of feedback microphone 56 may be changed from that illustrated in FIG. 1. Further, in some embodiments, more than one feedback microphone 56 may be used.

Figure 2:
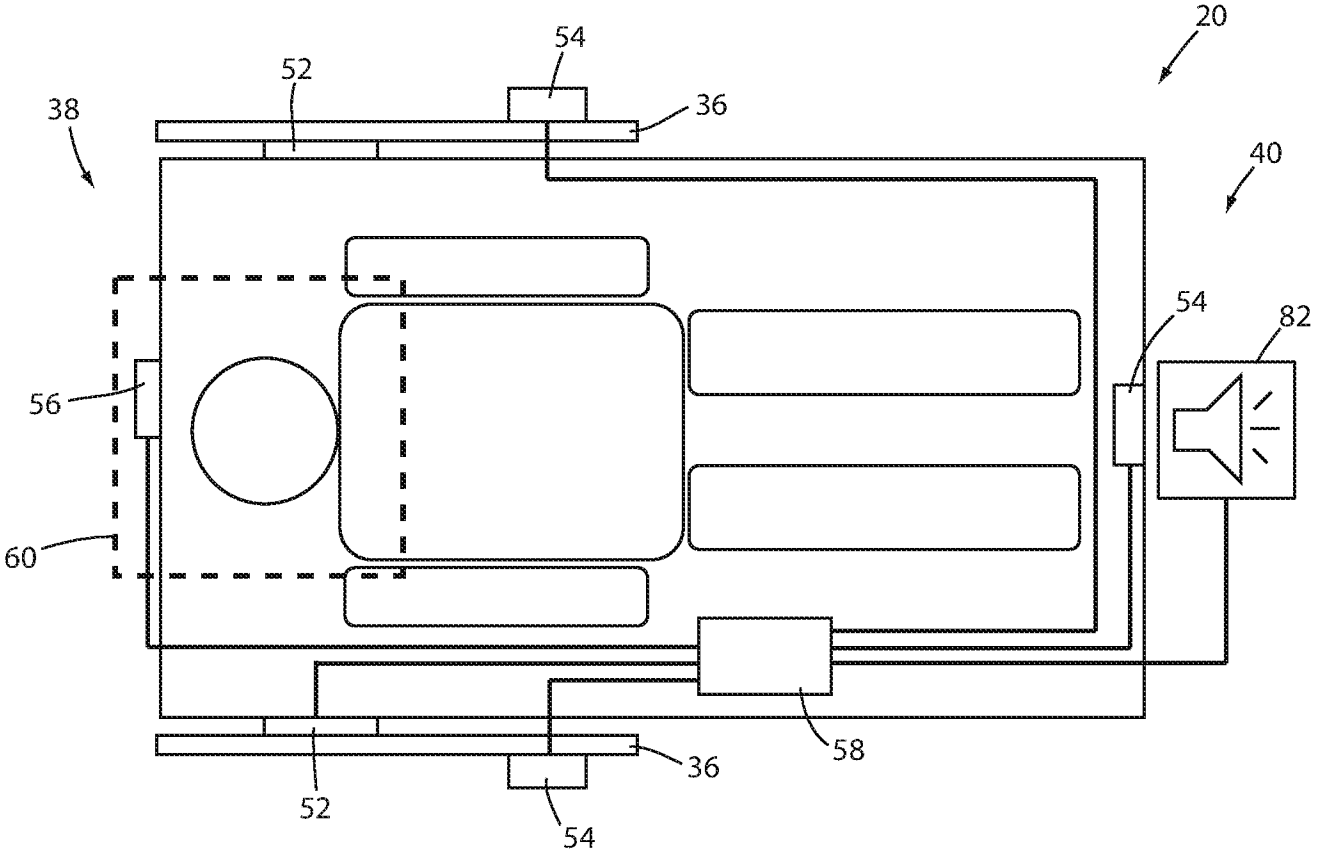
FIG. 2 is a block diagram of the person support apparatus of FIG. 1.

As is shown more clearly in FIG. 2, each of speakers 52 and microphones 54 and 56 are communicatively coupled to a controller 58. Controller 58 and speakers 52 collectively define an active noise cancellation device. Controller 58 is constructed of any electrical component, or group of electrical components, that are capable of carrying out the functions described herein. In many embodiments, controller 58 is a conventional microcontroller, although not all such embodiments need include a microcontroller. In general, controller 58 includes any one or more microprocessors, microcontrollers, field programmable gate arrays, systems on a chip, volatile or nonvolatile memory, discrete circuitry, and/or other hardware, software, or firmware that is capable of carrying out the functions described herein, as would be known to one of ordinary skill in the art. Such components can be physically configured in any suitable manner, such as by mounting them to one or more circuit boards, or arranging them in other manners, whether combined into a single unit or distributed across multiple units. The instructions followed by controller 58 in carrying out the functions described herein, as well as the data necessary for carrying out these functions, are stored in a memory accessible to controller 58.

Controller 58 is programmed to actively cancel one or more noise sound waves that would otherwise impinge upon a quiet zone 60 of person support apparatus 20. As shown in FIG. 2, quiet zone 60 is generally defined adjacent head end 38 of person support apparatus 20. The volume and shape of quiet zone 60 may be changed from what is shown in FIG. 2. Generally speaking, quiet zone 60 is defined so as to encompass the region of person support apparatus 20 wherein the occupant's head is most likely to be positioned. In some embodiments, quiet zone 60 is static with respect to its size, shape, and/or position. In other embodiments, quiet zone 60 is dynamic with respect to any one or more of its size, shape, and position. As will be explained in greater detail below, in some embodiments, controller 58 is able to determine the current location of the occupant's head and uses this information to control the positioned of quiet zone 60 so that it encompasses the occupant's head. In this manner, the occupant's ears are positioned inside the quiet zone and thus do not detect the noise sound waves (or detect a reduced version of the noise sound waves). The size and position of quiet zone 60 are controlled via the noise cancellation signals 66 that controller 58 sends to speakers 52, as will be discussed in greater detail below.

Controller 58 actively cancels noise by generating anti-noise signals that are fed to speakers 52. The anti-noise signals are converted by the speakers into noise cancelling sound waves that, when they interact with the ambient noise sound waves, reduce or eliminate the amplitudes of the noise sound waves. This process is illustrated in more detail in FIG. 3. As shown therein, one or more of microphones 54 detects a noise sound wave 62. The noise sound wave 62 is converted by microphone 54 into a noise signal 64 that is electrically communicated to controller 58. Controller 58 analyzes the noise signal 64 in order to generate a noise cancellation signal 66 that is forwarded to a speaker 52. Speaker 52 converts the noise cancellation signal 66 into a noise cancellation sound wave 68. When the noise cancellation sound wave 68 meets the noise sound wave 62, the two substantially cancel each other out because they are essentially the same sound wave shifted apart from each other by 180 degrees. The peaks of the noise sound wave 62 are therefore met by the troughs of the noise-cancelling sound wave 68 while the troughs of the noise sound wave 62 are met by the peaks of the noise-cancelling sound wave 68. Due to the additive nature of sound waves, the peaks cancel the troughs and the troughs cancel the peaks, thereby resulting in substantially complete elimination of the noise sound wave within quiet zone 60.

Controller 58 generates the noise cancellation signal 66 based upon several criteria. These criteria include measurements of the amplitude, frequency, and phase of the noise signal 64. Further, controller 58 uses stored knowledge of the relative position of microphone 54 with respect to speaker 52, and/or the amount of processing delay involved in generating the noise cancellation sound wave 68. Controller 58 uses the amplitude, frequency, and phase of the noise signal 64 to determine the amplitude, frequency, and phase of the noise cancellation signal 66. Controller 58 uses the relative position information and/or the processing delays to determine when to have speakers 52 emit the noise cancelling sound wave 68. In other words, controller 58 uses knowledge of how long it will take for the noise sound wave 62 detected at microphone 54 to arrive at quiet zone 60, subtracts the processing time necessary to generate the noise cancelling sound wave 68 from the predicted arrival time of noise sound wave 62 at quiet zone 60, and sends noise cancelling signal 66 to speakers 52 at the appropriate time so that it generates noise cancelling sound wave 68 at the appropriate time to cancel noise sound wave 62 within quiet zone 60. The timing of the emission of the noise cancelling sound wave 68 is changed, in some embodiments, in order to adjust the location of quiet zone 60 (i.e. the location where the noise cancelling sound wave 68 most effectively cancels the noise sound wave 62).

In those embodiments of person support apparatus 20 where speakers 52 and/or microphones 54 are not positioned in a fixed spatial relationship to each other, person support apparatus 20 includes one or more sensors for determining the current spatial relationship between the two. For example, in the embodiment shown in FIGS. 1 and 2, microphone 54 positioned on footboard 34 does not maintain a fixed spatial relationship with speakers 52 because speakers 52 are mounted to movable siderails 36 that are movable between raised and lowered positions. Further, the siderails 36 to which speakers 52 are mounted are coupled to Fowler section 42 of support deck 30, which is pivotable between a flat orientation and a plurality of raised orientations. Accordingly, the distance between speakers 52 and the microphone 54 of footboard 34 is variable.

Because of the variable distance between footboard microphone 54 and speakers 52, the timing of the moment at which speakers 52 must begin outputting noise cancelling sound wave 68 in order to cancel the noise sound wave 62 (detected by footboard microphone 54) within quiet zone 60 will also change. Controller 58 computes this timing adjustments based upon sensor outputs that indicate the current position of speakers 52. In some embodiments, these sensor outputs include an angle sensor that measures the angle of Fowler section 42 relative to horizontal (or relative to another defined reference), and one or more siderail sensors that detect the position of siderails 36 relative to quiet zone 60.

However, in some embodiments of person support apparatus 20, the spatial relationship between speakers 52 and microphones 54 does not change. For example, in at least one embodiment, person support apparatus 20 is modified so as to not include microphone 54 mounted to footboard 34. In this modified embodiment, person support apparatus 20 only includes a microphone 54 on each siderail 36 to which a speaker 52 is mounted. Although each siderail 36 is still movable between raised and lowered positions, the relative spatial relationship between each microphone 54 and speaker 52 does not change because they are each mounted to a common siderail 36.

In some of the embodiments of person support apparatus 20 where only two microphones 54 are included (one on each siderail 36), controller 58 generates a separate noise cancellation signal 66 for each speaker 52 based upon the noise sound wave 62 detected by the corresponding sound wave 62. That is, controller 58 generates a noise cancellation signal 66 for the speaker 52 coupled to the right head end siderail 36 based upon the noise sound wave 62 detected by the microphone 54 coupled to the right head end siderail 36, and controller 58 generates a separate noise cancellation signal 66 for the speaker 52 coupled to the left head end siderail based upon the noise sound wave 62 detected by the microphone 54 coupled to the left head end siderail 36. In other embodiments, controller 58 may use the noise signals 64 from multiple microphones 54 to generate one or more noise cancellation signals 66.

Figure 3:
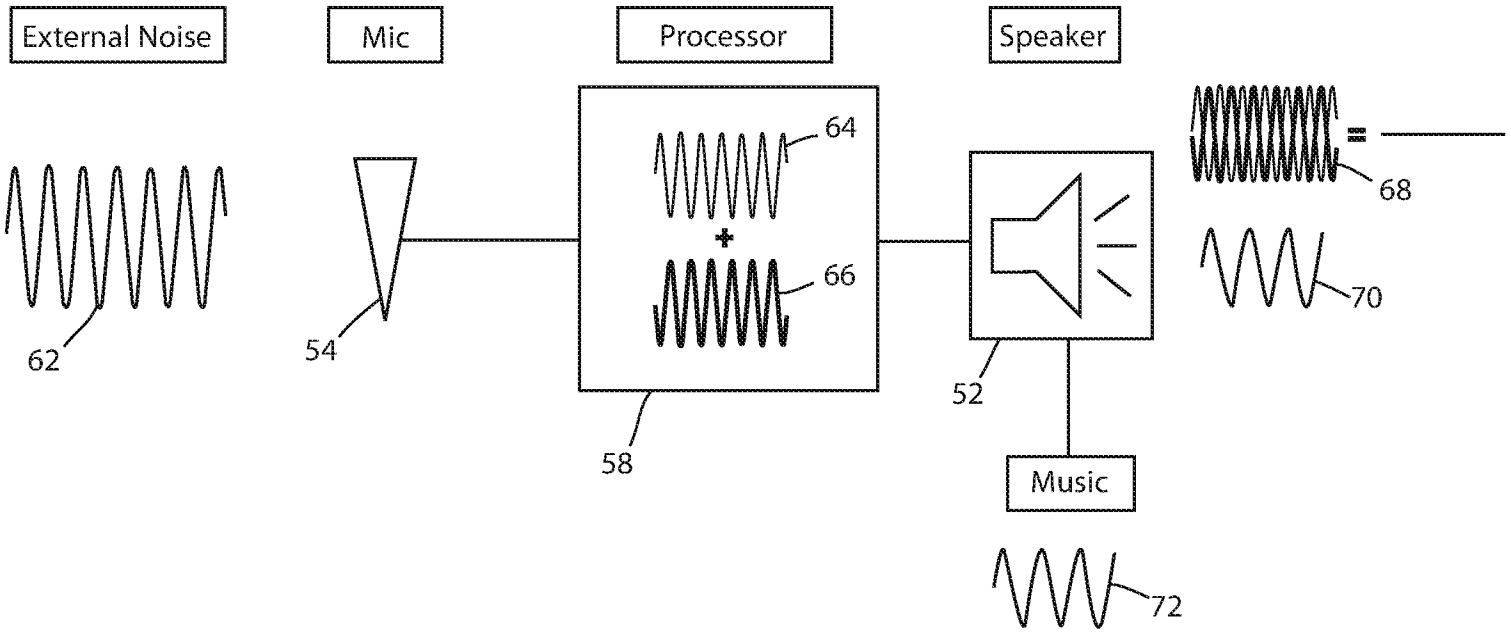
FIG. 3 is a diagram illustrating an active noise cancellation method followed by an active noise cancellation device of the person support apparatus of FIGS. 1 and 2.

It will be understood that, although FIG. 3 depicts the noise sound wave 62 as having a constant frequency and amplitude, this is not necessary for the active noise cancellation performed by controller 58 and speakers 52. That is, controller 58 is programmed to generate noise cancellation signals 66 for noise sound waves 62 that have varying amplitudes, frequencies, and/or phases.

In the embodiment shown in FIGS. 1 and 2, person support apparatus 20 further includes feedback microphone 56. Feedback microphone 56 is positioned inside of quiet zone 60 and reports any sound waves it detects to controller 58. The detected sound waves should include the sum of the noise sound wave 62 and the noise cancellation sound wave 68. Controller 58 uses the sound signals from feedback microphone 56 as feedback for gauging the relative success of the noise cancellation and to make one or more adjustments to the noise cancelling signal 66. Such adjustments include adjustments to the amplitude, phase, and/or frequency of the noise cancelling signal 66 in order to bring about improved cancellation of the noise sound wave 62. In some embodiments, two feedback microphones 56 are included, one for each speaker 52. In still other embodiments, still more feedback microphones may be included.

In some instances, an occupant of person support apparatus 20 may be using speakers 52 for playing desired sounds, such as music or the audio from a television, at the time a noise sound wave is generated. Such a desired sound is illustrated in FIG. 3 by desired sound wave 70. Desired sound wave 70 is created by speaker 52 from a desired sound signal 72 that is fed to speaker 52. Desired sound signal 72 is added to the noise cancellation sound signal 66 and fed to speaker 52. Speaker 52 then generates a sound wave that includes a noise cancellation component and a desired component. The noise cancellation component cancels the noise sound wave 62, leaving only the desired component.

Controller 58 generates noise cancellation signal 66 in the same manner as previously described, regardless of whether or not speaker 52 is also generating a desired sound wave 70 or not. However, in those instances where controller 58 is using feedback from feedback microphone 56 to adjust noise cancellation signal 66, controller 58 subtracts the desired sound signal 72 from the signal sensed by feedback microphone 56. Any signal that remains after this subtraction should be the result of incompletely cancelled noise, which controller 58 uses to adjust noise cancellation signal 66.

Figure 4:
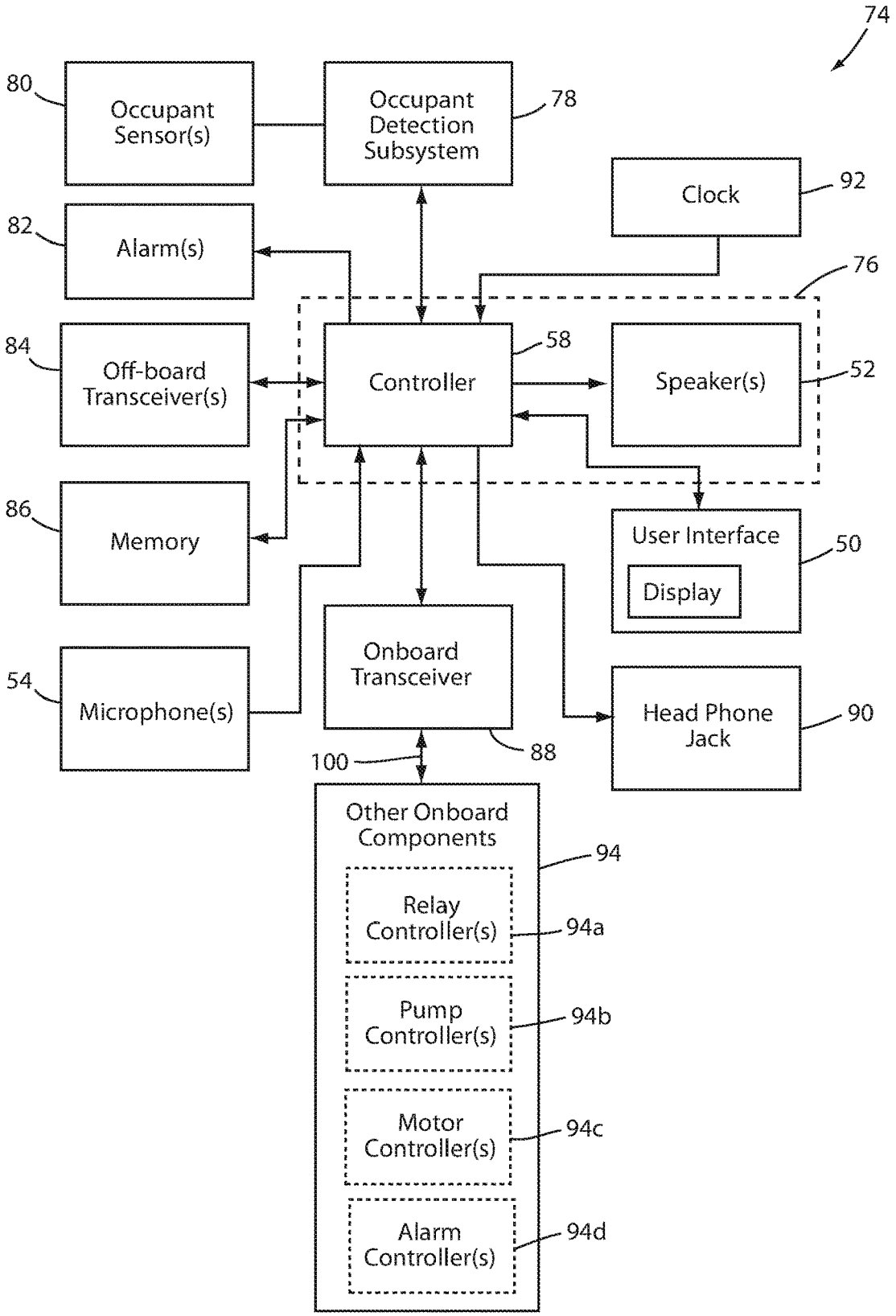
FIG. 4 is a detailed block diagram of a control system usable with any of the person support apparatuses disclosed herein.

FIG. 4 illustrates a control system 74 that may be used with the person support apparatus 20 of FIGS. 1 and 2. Control system 74 of FIG. 4, however, also includes a number of components and features that have not been described with respect to person support apparatus 20. These additional components and features, which are discussed in more detail below with respect to several additional embodiments, may be added to person support apparatus 20. Alternatively these additional components and features may be omitted from person support apparatus 20.

Control system 74 includes controller 58, one or more speakers 52, and one or more microphones 54. Controller 58 and the one or more speakers 52 collectively define an active noise cancellation device 76. Control system 74 further includes an occupant detection subsystem 78 having one or more occupant sensors 80, one or more alarms 82, one or more off-board transceivers 84, a memory 86, an onboard transceiver 88, a head phone jack 90, a clock 92, and one or more other onboard components 94 that are able to communicate with controller 58 via onboard transceiver 88. The one or more other onboard components 94 may include one or more relay controllers 94*a*, one or more pump controllers 94*b*, one or more motor controllers 94*c*, and/or one or more alarm controllers 94*d*.

Occupant detection subsystem 78 determines whether person support apparatus 20 is currently occupied or not. In some embodiments, if person support apparatus 20 is not occupied, controller 58 does not perform any active noise cancellation. In such embodiments, controller 58 is configured to automatically provide active noise cancellation when person support apparatus 20 is occupied and to not provide active noise cancellation when person support apparatus 20 is not occupied. Also, in some embodiments, occupant detection subsystem 78 determines a position of the occupant's head relative to speakers 52 and/or quiet zone 60. Controller 58 uses this information to make fine tune adjustments to the noise cancellation signal 66 such that the most effective noise cancelling regions of quiet zone 60 are aligned with the occupant's head and/or ears. Thus, for example, if the occupant's head is positioned closer to the left head end siderail 36 than the right head end siderail 36, controller 58 adjust the noise cancellation signals 66 from each speaker 52 such that the most effective region of noise cancellation occurs is in a region closer to the left head end siderail 36 than the right head end siderail 36.

When occupant detection subsystem 78 is adapted to determine only the absence or presence of the occupant, occupant sensors 80 may be implemented as a plurality of force sensors, such as, but not limited to, load cells that detect the weight and/or center of gravity of the occupant. Illustrative manners in which such force sensors can be used to detect the presence and absence of an occupant, as well as the center of gravity of the occupant, are disclosed in the following commonly assigned U.S. patent references: U.S. Pat. No. 5,276,432 issued to Travis and entitled PATIENT EXIT DETECTION MECHANISM FOR HOSPITAL BED; and U.S. Pat. application Ser. No. 62/253,167 filed Nov. 10, 2015, by inventors Marko Kostic et al. and entitled PERSON SUPPORT APPARATUSES WITH ACCELERATION DETECTION, the complete disclosures of both of which are incorporated herein by reference. Other algorithms for processing the outputs of the force sensors may also be used for detecting an occupant's presence and absence.

Occupant detection subsystem 78 may be implemented in other manners in other embodiments. For example, in some embodiments, occupant detection subsystem 78 includes one or more thermal sensors that are used as occupant sensors 80 to detect the absence/presence of the occupant and/or the position of the occupant's head on person support apparatus 20. Further details of such a thermal sensing system are disclosed in commonly assigned U.S. patent application Ser. No. 14/692,871 filed Apr. 22, 2015, by inventors Marko Kostic et al. and entitled PERSON SUPPORT APPARATUS WITH POSITION MONITORING, the complete disclosure of which is incorporated herein by reference.

In still other embodiments, occupant detection subsystem 78 detects the absence or presence of an occupant using one or more of the methods disclosed in commonly assigned U.S. patent application Ser. No. 14/928,513 filed Oct. 30, 2015, by inventors Richard Derenne et al. and entitled PERSON SUPPORT APPARATUSES WITH PATIENT MOBILITY MONITORING, the complete disclosure of which is also hereby incorporated herein by reference. In still other embodiments, occupant detection subsystem 78 includes one or more video cameras as occupant sensors 80 for detecting an occupant's presence, absence, and/or position, such as disclosed in commonly assigned U.S. patent application Ser. No. 14/578,630 filed Dec. 22, 2014, by inventors Richard Derenne et al. and entitled VIDEO MONITORING SYSTEM, the complete disclosure of which is also hereby incorporated herein by reference. In yet another alternative embodiment, the presence, absence, and/or position of an occupant is detected using a pressure sensing mat as an occupant sensor 80. The pressure sensing mat is positioned on top of the mattress or support deck 30, such as is disclosed in commonly assigned U.S. patent application Ser. No. 14/003,157 filed Mar. 2, 2012, by inventors Joshua Mix et al. and entitled SENSING SYSTEM FOR PATIENT SUPPORTS, the complete disclosure of which is also incorporated herein by reference. In still other embodiments, occupant detection subsystem 78 may take on still other forms.

Control system 74 also includes one or more alarms 82 that are directly controlled by controller 58. The alarms include a device that produces sound at known frequencies, of a known amplitude, and a known phase relative to quiet zone 60. The device may be a buzzer, beeper, speaker, or other audio-producing component. In some instances, the audio components of alarms 82 (as opposed to a visual component, if any) are repeated multiple times, such as a series of beeps, and in those instances the duration of the beeps and time interval between the beeps is known. These known quantities may be determined or programmed during the manufacture of person support apparatus 20, determined by testing after manufacture, or otherwise determined. These known quantities are stored in memory 86 and used by controller 58 to selectively produce a noise cancellation signal 66 that cancels the audio component of alarms 82 within quiet zone 60.

The selective production of the noise cancellation signal 66 based upon alarms 82 is determined ahead of time. That is, in some embodiments of person support apparatus 20, there are one or more alarms 82 that are desirably heard by people who are not occupants of person support apparatus 20 (e.g. healthcare providers) but desirably not heard by the occupant of person support apparatus 20. There may also be one or more alarms that are desirably heard both by the occupant of person support apparatus and individuals who are not occupants of person support apparatus 20. Memory 86 includes a list of which alarms 82 are to be quieted (i.e. treated with active noise cancellation) for the occupant and which alarms 82 are not to be quieted for the occupant. For those alarms 82 that are to be quieted for the occupant, controller 58 produces a noise cancellation signal 66 that cancels the audio component of the alarm 82 within quiet zone 60.

When controller 58 sends a noise cancellation signal 66 to speakers 52 based upon the audio component of a known alarm 82, it does not need to detect the noise sound wave 62 associated with the audio component of the alarm 82 via microphones 54. Instead, controller 58 generates the noise cancellation signal 66 (or reads from memory 86 a pre-stored noise cancellation signal 66) that is based upon known information stored in memory 86 regarding alarm 82. In addition to the amplitude, frequency (or frequencies), and phase of the audio component of the alarm 82, the known information stored in memory 86 includes data indicating how long controller 58 should delay between sending the start message or signal to alarm 82 before sending the corresponding noise cancellation signal 66 to speakers 52. This known delay may be determined based upon tests performed by the manufacturers of the person support apparatus; by calculations based upon the distance(s) between the source of alarm 82, speakers 52, and predefined boundaries of quiet zone 60; and/or by other means. In some instances, the known delay is dynamic and changes based upon the position of siderails 36 (with speakers 52 attached thereto) and/or Fowler section 42. In other cases, the delay is static. However, regardless of a static or dynamic delay, because controller 58 controls both the alarm 82 and the forwarding of noise cancellation signal 66 to speakers 52, controller 58 is able to time the meeting of the noise cancelling sound wave 68 with the sound wave of the alarm 82 within quiet zone 60 such that the two cancel each other out, thereby aurally shielding the occupant from the noise of the alarm 82.

In some embodiments, the cancellation of sound waves from alarm 82 within quiet zone 60 is based upon one or more additional factors. For example, as mentioned, in some embodiments, such cancellation only occurs if person support apparatus 20 is occupied. Alternatively, or additionally, in some embodiments, such cancellation only occurs at certain times of the day. For example, in some embodiments, controller 58 only cancels alarm 82 sounds within quiet zone 60 during nighttime hours. (Controller 58 determines these based upon clock 92). Still further, in some embodiments, user interface 50 is configured to allow a user (such as a caregiver) to selectively configure not only when an alarm 82 is quieted in quiet zone 60, but also to select which alarms 82 are quieted and which alarms 82 are not quieted. Thus, user interface 50 enables the user to fully customize which alarms are quieted and when.

Although controller 58 is able to cancel the audio component of known alarms 82 within quiet zone 60 without detecting the corresponding sound wave 62 of the alarms 82 via microphones 54, this does not mean that controller 58 ignores the outputs of microphones 54 during the quieting of the alarms 82. Instead, controller 58 is programmed, in at least one embodiment, to continue to generate a noise cancellation signal 66 in response to any unknown noise sound waves 62 detected by microphones 54 that are separate from the known alarm noise wave 62. Such noise cancellation signals 66 are generated in addition to the noise cancellation signal 66 generated in response to the audio component of the known alarm 82. Thus, for example, if a known alarm 82 is currently emitting a sound while some other noise source (which could be on-board or off-board person support apparatus 20) is also emitting a noise sound wave, controller 58 generates (or reads from memory 86) a first noise cancellation signal 66 that is designed to cancel the known alarm 82 and a second noise cancellation signal 66 that is designed to cancel the sound from the unknown source. The two signals 66 are added together and sent to speakers 52 so that the sound waves from both alarm 82 and the unknown source are quieted within quiet zone 60.

The generation of the second noise cancellation signal 66 is based upon the outputs from the microphone 54 after the sound components of the known alarm detected by the microphone have been filtered out. In other words, when controller 58 is cancelling a known noise sound wave 62 based upon stored pitch and/or other data for the known noise sound wave 62, controller 58 filters out the components of the known noise sound wave 62 from the output(s) of the microphone(s) 55. The result of this filtering leaves only the unknown noise sound wave 62 components. Controller 58 generates an anti-noise signal for this unknown noise sound wave component, adds it to the anti-noise signal 66 generated for the known noise sound wave component (i.e. known alarm), and sends the sum to speaker(s) 52.

In some embodiments, controller 58 uses the outputs of the microphone(s) 54 to initially determine and/or adjust the timing or phase information of the known noise sound wave 62. After this timing or phase information is determined, controller 58 may then switch to generating the noise cancellation sound wave 68 based upon the determined timing or phase information in combination with the other known characteristics of the noise sound wave 62 without utilizing the outputs from microphone(s) 54. In still other embodiments, controller 58 may be configured to not have access to any known alarm information (or other known noise information) and simply cancel detected noise sound waves 62 based completely upon the outputs from microphone(s) 54.

Control system 74 (FIG. 4) also includes one or more head phone jacks 90. Head phone jacks 90 are adapted to receive plugs from a conventional set of headphones (not shown). The headphones are worn by the occupant of person support apparatus 20. Noise cancellation signals 66 are delivered by controller 58 to head phone jacks 90 in the same manner as noise cancellation signals 66 are delivered to speakers 52, as has been discussed above. In some embodiments, one or more minor modifications may be made to the noise cancellation signals 66 delivered to head phone jacks 90 as compared to the noise cancellation signals 66 delivered to speakers 52, such as changes in the amplitude in order to accommodate the different acoustics of the headphones. Further, in some embodiments, person support apparatus 20 includes a sensor to detect when headphones are coupled to jack 90. In such instances, controller 58 delivers the noise cancellation signals 66 only to head phones jack 90 and not to speakers 52 if the presence of headphones is detected. If no headphones are plugged into jack 90, controller 58 delivers the noise cancellation signals 66 only to speakers 52 and not head phone jack 90. Still further, in at least some embodiments, one or more microphones 54 are integrated into the headphones and detect incoming noise sound waves 62 and/or one or more feedback microphones 56 are integrated into the headphones to detect the sounds, if any, adjacent the patient's ear canal.

As with speakers 52, controller 58 is configured to also deliver one or more desired sound signals 72 to head phone jacks 90 in order for the headphones to create corresponding desired sound waves 70 for the occupant of person support apparatus 20. These desired sound signals 72 are added to any noise cancellation signals 66 delivered to head phone jacks 90. In this manner, the occupant of person support apparatus 20 is able to listen to music, television audio, or other desired sound waves 70 while wearing headphones, yet simultaneously have undesired noise signals actively cancelled via noise cancellation signals 66 that are delivered to the head phones.

Control system 74 (FIG. 4) also includes one or more off-board transceivers 84. Off-board transceivers 84 are configured to communicate with one or more off-board devices, such as, but not limited to, medical devices positioned within the aural vicinity of person support apparatus 20. Off-board transceivers 84 may be wired and/or wireless transceivers. When configured for wired communication with off-board devices, transceiver 84 may be an Ethernet transceiver, an RS-232 transceiver, a Universal Serial Bus (USB) transceiver, or any other known wired transceiver. When configured for wireless communication, off-board transceivers 84 may include a WiFi transceiver (IEEE 802.11), a ZigBee transceiver (IEEE 802.15.4) a Bluetooth transceiver (IEEE 802.15.1), an infrared transceiver, a near field transceiver (e.g. ISO/IEC 14443), an ultrasonic transducer, and/or any other known wireless transceiver.

Off-board transceiver 84 is adapted to receive a notification signal from an off-board device via a communication link 98 (FIG. 5) between person support apparatus 20 and the off-board device. As noted, the communication link may be a wired link or a wireless link. The notification signal is sent by the off-board device prior to the off-board device emitting a sound (e.g. an alarm). Controller 58 analyzes the notification signal to determine not only the amplitude, phase, and frequenc(ies) of a noise cancellation signal 66 adapted to cancel the sound from the off-board device, but also to determine the appropriate timing for emitting the noise cancellation signal 66 so as to cause active noise cancellation of the sound wave from the off-board device within quiet zone 60. This process is explained in more detail below with reference to FIG. 5.

Figure 5:
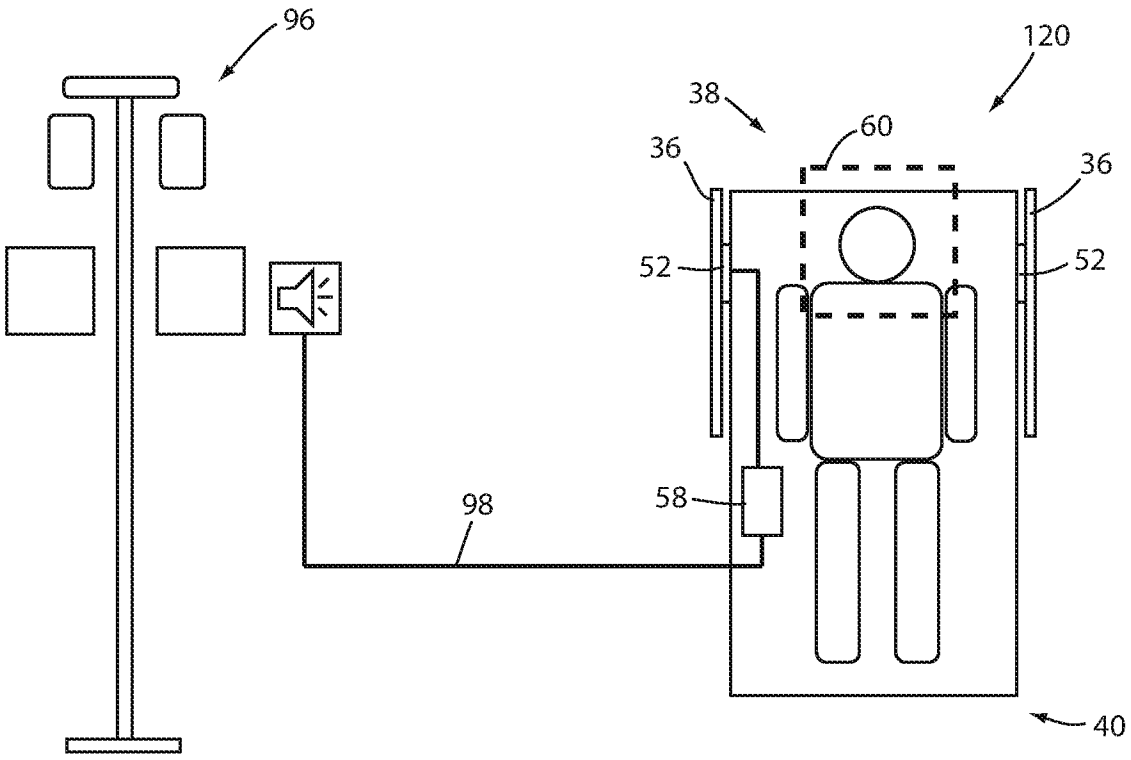
FIG. 5 is a block diagram of a person support apparatus according to another embodiment of the disclosure.

FIG. 5 illustrates one example of an off-board device 96 that is communicatively coupled to a person support apparatus 120 via a communication link 98 (which may be wired or wireless). In this illustrative example, off-board device 96 is an IV stand adapted to deliver intravenous fluid to the occupant of person support apparatus 120. It will be understood that off-board device 96 may take on a variety of other forms including any devices that are adapted to emit sounds, whether medical or non-medical (and including other person support apparatuses—see person support apparatuses 320 discussed more below). Person support apparatus 120 includes a number of components that are the same as components of person support apparatus 20. Those components have been given the same reference number and, unless otherwise stated, operate in the same manner as previously described. Person support apparatus 120 is also illustrated without one or more components of person support apparatus 20 (e.g. microphones 54). It will be understood that person support apparatus 120 can be modified to include any of the components of person support apparatus 20 that are not shown in person support apparatus 120 of FIG. 5. It will also be understood that person support apparatus 120 can be modified to include any of the components and/or functions of control system 74 that are not explicitly described below as being incorporated into person support apparatus 120.

Person support apparatus 120 is designed to cancel sound waves produced by off-board devices 96. Such sound cancellation is accomplished based upon the receipt of one or more notification signals sent by off-board device 96 to off-board transceiver 84 prior to the emission of the sound by off-board device 96. The notification signals include information regarding one or more of the following characteristics of the sound waves to be emitted by off-board device 96: an amplitude of the emitted sound wave, a frequency (or frequencies) of the emitted sound wave, a start time at which the emitted sound wave will be emitted, a stop time at which the emitted sound wave will be terminated, a phase of the emitted sound wave, a duration of the emitted sound wave, a duration of an interval between emissions of the sound wave, and/or a number of times the sound wave is to be repeated. Still other information may be included.

In the embodiment illustrated in FIG. 5, off-board device 96 sends the notification signal as an ultrasonic sound wave and off-board transceiver 84 includes an ultrasonic transducer to detect the ultrasonic sound wave. The notification signal is sent as an ultrasonic sound wave so as to not be heard by the occupant of person support apparatus 120, yet still provide information to controller 58 regarding the phase and timing of the future sound wave, as will be discussed more below. In response to the notification signal, controller 58 generates a noise cancellation signal 66 that is designed to cancel the sound emitted from off-board device 96. Controller 58 times the emission of noise cancellation sound wave 68 from speakers 52 so as to cancel out the sound wave from off-board device 96 within quiet zone 60.

In one embodiment, off-board device 96 encodes information within the ultrasonic notification signal by changing the amplitude, pitch, and/or frequency of the ultrasonic signal. The encoded information includes any of the information mentioned above (pitch, amplitude, phase, timing info, etc.). The encoded information may include synchronization data used by controller 58 to precisely control when noise cancellation sound wave 68 is to be produced so as to cancel the upcoming sound wave from off-board device 96 within quiet zone 60. That is, the synchronization data tells controller 58 exactly when (i.e. with sufficient precision to enable effective noise cancellation) the sound wave from off-board device 96 will arrive at person support apparatus 120. The ultrasound data may also be transmitted at a known relative amplitude with respect to the amplitude of the upcoming alarm so that controller 58 can determine the amount of attenuation of the upcoming alarm sound waves will undergo before arriving at quiet zone 60. The amount of attenuation is computed by comparing the amplitude of the received ultrasonic sound wave with the known amplitude of the ultrasonic sound wave when emitted.

In an alternative embodiment, one or more items of data about the future sound to be emitted by off-board device 96 are communicated to person support apparatus 120 over communication 98 using electromagnetic waves. Such items of data include any of the aforementioned items (e.g. pitch, amplitude, phase, duration, repetitions rate, etc.). In such embodiments, person support apparatus 120 includes two off-board transceivers 84: an electromagnetic transceiver and an ultrasonic transceiver. Because the distance between the off-board device 96 and person support apparatus may vary, the amount of attenuation experienced by the sound waves from off-board device 96 by the time they arrive at quiet zone 60 may vary. In order to accurately predict this attenuation, as noted, information about the amplitude of the transmitted ultrasonic notification signal is sent to controller 58 and controller 58 compares the broadcast amplitude with the amplitude actually detected at transceiver 84. This attenuation level may then be used as a proxy for the attenuation level to be expected for the upcoming alarm sound (and/or it may be modified slightly to account for known attenuation differences between ultrasonic signals and sonic signals).

Regardless of whether or not the notification signal(s) are sent purely as an ultrasonic signal or a combination of both ultrasonic and electromagnetic signals, the ultrasonic signals are used to determine attenuation and the precise arrival time of the upcoming sound wave. Using that information, along with information about the frequenc(ies) of the upcoming alarm and/or other information, controller 58 generates a noise cancellation signal 66 that cancels the alarm from off-board device 96 within quiet zone 60. In this manner, the occupant of person support apparatus 120 is shielded from alarms and/or other noises from surrounding devices 96.

Although FIG. 5 only illustrates a single off-board device 96 as emitting an alarm that is cancelled by person support apparatus 120 within quiet zone 60, it will be understood that this illustration was provided merely for purposes of explaining the principle of operation. Thus, person support apparatus 120 is configured to cancel sounds from as many off-board devices 96 as may be in the vicinity of person support apparatus 120. Still further, as with person support apparatus 20, person support apparatus 120 is configurable via user interface 50 to select which off-board devices 96 are to be quieted and/or at what times such off-board devices 96 are to be quieted. A user can therefore decide, for example, that none of the off-board devices 96 are to be quieted during daytime hours, while all of the sounds are to be cancelled in the evening. Other configurations are, of course, possible.

In at least one embodiment, person support apparatus 120 also includes the on-board noise cancelling features of person support apparatus 20. That is, although not illustrated in FIG. 5, person support apparatus 120 is configured in at least one embodiment to additionally cancel sound waves from an on-board alarm 82 in the manners described above with respect to person support apparatus 20. In such embodiments, person support apparatus 120 is able to quiet (within quiet zone 60) the sounds from both its own alarms and the alarms (or other noises) from off-board devices 96.

In still another embodiment, person support apparatus 120 is modified to include one or microphones 54 that are used in any of the same manners described above with respect to person support apparatus 20. That is, in such embodiments, person support apparatus 120 is additionally configured to cancel ambient noises within quiet zone 60 that are detected by microphones 54.

In some embodiments, when person support apparatus 120 is modified to include one or more microphones, the use of an ultrasonic (or other non-electromagnetic) transceiver 84 can be avoided. In some of those embodiments, controller 58 uses microphones 54 not for determining the content of noise cancelling signals 66 used to cancel predictable noises—such as alarms whose amplitude, pitch, duration, etc. are known—but instead only uses the microphones 54 for determining the timing at which noise cancelling signals 66 for such predictable noises are fed to speakers 52. This use of microphones 54 for timing information rather than content information is discussed more below.

Many alarms in hospital settings (or other type of healthcare facilities) are standardized. These standards include standards for pitch (including harmonics and overtones), amplitude, repetition rate, duration of intervals, etc. One example of such standardization for healthcare alarms is found in standard 60601-1-8 of the British Standards Institution. Other examples include IEC 60601-1-11-2015 and ISO 14971:2000. Still other standards are known. In those embodiments of person support apparatus 120 where controller 58 uses microphones 54 for timing information regarding sounds from an off-board device 96, controller 58 is programmed to use data stored in memory 86 regarding standardized alarms. More specifically, controller 58 uses stored standardized alarm data to determine what characteristics the sound wave coming from off-board device 96 will have. Based on these characteristics, along with knowledge of when the sound wave from off-board device 96 was first detected, controller 58 generates a corresponding noise cancellation signal 66 for delivery to speaker 52. In this manner, controller 58 uses microphones 54 to time the production of noise cancelling signal 66 but uses on-board standardization data to construct the content of noise cancelling signal 66. In such embodiments, the occupant of person support apparatus 120 may hear a small initial portion of the sound wave from off-board device 96 until controller 58 synchronizes its noise cancelling signal 66 to cancel the sound wave within quiet zone 60. The duration of this sound wave within quiet zone 60 before being cancelled is, in some embodiments, less than a second.

The existence of this brief un-cancelled sound wave from off-board device 96 may result from controller 58 not being able to accurately determine precisely when the sound wave from the off-board device 96 will arrive at quiet zone 60 prior to detecting the sound wave with microphone 54. This may occur due to the differences in speed between the sound wave and the speed of the electromagnetic waves used to transmit the notification signal. In other words, a notification signal sent from off-board device 96 to person support apparatus 120 regarding the upcoming sound wave from off-board device 96 will arrive at person support apparatus 120 sooner than the sound wave, and the different speeds between electromagnetic communication and acoustic communication may render it difficult to predict when the sound wave arrives prior to its actual arrival. Accordingly, controller 58 may not be able to cancel out all of the sound wave from off-board device 96 within quiet zone 60 until timing and/or phase information can be determined from the microphone signals.

In still another modified embodiment of person support apparatus 120, controller 58 does not receive any notification signal from off-board device 96 (whether electromagnetic or acoustic) and instead cancels the sound from off-board device 96 based upon stored information contained within memory 86, along with an initial sampling of the noise sound wave 62 from one or more microphones 54. Such stored information may include the alarm standardization information discussed above. Alternatively or additionally, such stored information may include sound information gathered when person support apparatus 120 was placed in a learning mode. While in a learning mode, person support apparatus 120 uses microphones 54 to record the sounds of one or more alarms (or other sounds) that it is intended to cancel. That is, a representative sample of a sound to be cancelled in the future is emitted within the vicinity of person support apparatus 120, detected by microphones 54, and stored in memory 86 for future use. In the future, when microphones 54 detect a sound to be cancelled, controller 58 searches memory 86 for a prerecorded sound file that matches the same initial characteristics of the detected sound wave and uses that data to generate noise cancellation signal 66. In some embodiments, person support apparatus 120 does not learn these sounds directly, but is fed sound data learned by another person support apparatus 120 via a wired or wireless connection to a server, or other database, that contains such sound information.

Although not shown in FIG. 5, person support apparatus 120 may also be modified to include one or more head phone jacks 90 for cancelling the sounds emitted from off-board device 96 while the occupant of person support apparatus 120 is wearing headphones. Additionally, person support apparatus 120 may be modified to include one or more feedback microphones 56 that are used to provide feedback regarding how well the noise cancellation sound wave 68 produced by speakers 52 is actually cancelling the noise sound wave 62 from off-board device 96 and/or from other sources.

Figure 6:
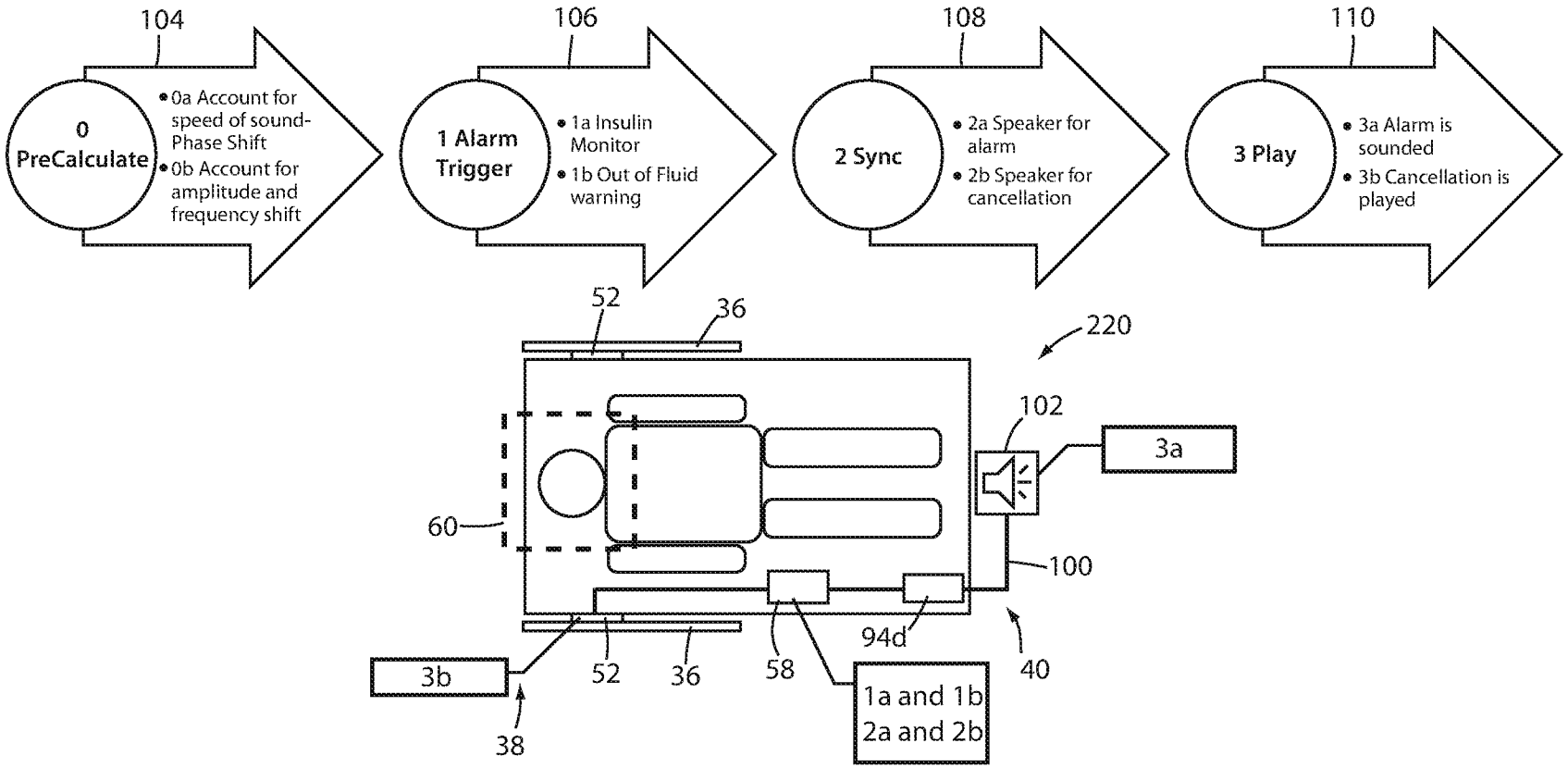
FIG. 6 is a block diagram of another person support apparatus according to yet another embodiment of the disclosure.

FIG. 6 illustrates another person support apparatus 220 according to the present disclosure. Person support apparatus 220 includes a number of components that are the same as components of person support apparatus 20 and/or 120. Those components have been given the same reference number and, unless otherwise stated, operate in the same manner as previously described. Person support apparatus 220 is also illustrated without one or more components of person support apparatus 20 and 120 (e.g. microphones 54). It will be understood that person support apparatus 220 can be modified to include any of the components of person support apparatus 20 and/or 120 that are not shown in person support apparatus 220 of FIG. 6. It will also be understood that person support apparatus 220 can be modified to include any of the components and/or functions of control system 74 that are not explicitly described below as being incorporated into person support apparatus 220.

Person support apparatus 220 includes a control system 74 (FIG. 4) having one or more onboard transceivers 88. Onboard transceivers 88 communicate with one or more other onboard components 94 of person support apparatus 220. As shown in FIG. 4, such other onboard components may include any one or more of a relay controller 94*a*, a pump controller 94*b*, a motor controller 94*c*, and/or an alarm controller 94*d*. It will further be understood that onboard transceivers 88 may communicate with other onboard components that are not explicitly identified in FIG. 4. In general, one or more onboard transceivers 88 are included that are in communication with any one or more sound generating devices on board person support apparatus 220 that are not directly controlled by controller 58.

Onboard transceiver 88 may be a conventional transceiver that is adapted to allow communications over the specific type of communication medium 100 (FIG. 4) that is used on person support apparatus 200. Communication medium 100 may be an electronic bus, one or more wire(s), fiber optics, or another type of media. As one example, onboard transceiver 88 may be an Ethernet transceiver that is used to communicate via onboard Ethernet cabling with one or more components 94. An example of a person support apparatus utilizing onboard Ethernet communications is disclosed in commonly assigned U.S. patent application Ser. No. 14/622,221 filed Feb. 13, 2015, by inventors Krishna Bhimavarapu et al. and entitled COMMUNICATION METHODS FOR PATIENT HANDLING DEVICES, the complete disclosure of which is hereby incorporated herein by reference. In other embodiments, onboard transceiver 88 may be a Serial Peripheral Interface (SPI) transceiver, an I-squared-C transceiver, a Controller Area Network (CAN) bus transceiver, a LONWorks transceiver, a USB transceiver, and/or still another type of transceiver. Still further, in some embodiments, communications medium 100 may be a bus having a port for connection to one or more external devices. In such cases, any of on-board transceivers 88 can operate as both an on-board and off-board transceiver, sending messages to both on-board nodes and off-board nodes.

Each of the controllers 94*a-d* shown in FIG. 4 may be a conventional microcontroller, discrete circuitry, or any other type of electrical component that is used to control the activation of a sound producing device (e.g. motor, pump, relay, alarm, etc.) on board person support apparatus 220. The alarms controlled by alarm controller 94*d* differ from the one or more alarms 82 that are implemented by controller 58 in that controller 58 does not directly control the timing of these alarms, unlike alarm 82. Instead, the timing of the activation and deactivation of these alarms is controlled by one or more alarm controller 94*d*.

In operation, each of the onboard controllers 94*a-d* sends a notification signal via an onboard communication medium 100 to controller 58 when they are about to activate the sound producing device over which they exercise control (e.g. relay, pump, motor, alarm, etc.). The notification signal includes information identifying the device that is to be activated and/or the sound that is going to result from the activation of the sound producing device. Controller 58 retrieves from memory 86 data that either specifies a corresponding noise cancellation signal 66 that will cancel the upcoming sound, or that allows controller 58 to generate the corresponding noise cancellation signal 66 that will cancel the upcoming sound. The notification signal from the controller 94*a, b, c*, and/or d includes information that enables controller 58 to determine the precise moment at which the noise cancellation signal 66 is to be played on speakers 52 to effectuate cancellation of the sound within quiet zone 60. This timing information may take on any suitable form and, in some embodiments, may include the exchange of a plurality of messages between the controller 94*a, b, c*, and/or d and the controller 58. Once the timing information is established, one or more of the controllers 94*a, b, c*, and/or d activate their corresponding sound emitting device while controller 58 simultaneously, or nearly simultaneously, sends the corresponding noise cancellation signal 66 to speakers 52 so that the noise from the device controlled by one of controllers 94*a-d* that would otherwise be heard by the occupant of person support apparatus 220 is cancelled within quiet zone 60.

The process followed by person support apparatus 220 in actively cancelling the sounds from one or more onboard components within quiet zone 60 is shown in more detail in FIG. 6. As shown therein, person support apparatus 220 includes an alarm 102 that is controlled by an alarm controller 94*d*. Prior to activating alarm 102, alarm controller 94*d* sends one or more notification signals to controller 58. Controller 58 uses the notification signals to determine the proper acoustic properties of noise cancellation sound wave 68, as shown in step 104 (FIG. 6). This determination is based upon the known relative position of alarm 102 to quiet zone 60 and/or speakers 52, and/or the known length of time and/attenuation the sound wave emitted by alarm 102 undergoes when traveling from alarm 102 to quiet zone 60 and/or speakers 52. As is shown in step 106, this determination is also based on an identification of the type of alarm (or other sound) that is going to be emitted. In the example shown in FIG. 6, the type of alarm is indicated as being an out of fluid warning for an insulin monitor. Other types of alarms, of course, can be aurally cancelled by person support apparatus 220.

By identifying the alarm type to controller 58 in the notification signal sent by controller 94*d*, controller 58 is able to retrieve from memory one or more characteristics (e.g. pitch, amplitude, duration, etc.) used to generate the appropriate noise cancellation signal 66. As illustrated in step 108, controller 58 communicates with controller 94*d* in order to appropriately synchronize the moment when alarm 102 will be activated and the noise cancellation signal 66 will be delivered to speakers 52. After step 108, the process proceeds to step 110 where alarm 102 emits its sound wave and speakers 52 emit their noise cancellation sound wave 68. The noise cancellation sound waves 68 are emitted at the appropriate time, with the appropriate spectral components, and with the appropriate amplitude so as to effectively cancel out the sound waves from alarm 102 within quiet zone 60.

Person support apparatus 220 is therefore able to quiet noises and/or sounds within quiet zone 60 that are generated from components onboard person support apparatus 220. Such onboard components may be either integrated into person support apparatus 220 (e.g. motors used to control the movement of deck 30) or coupled thereto (e.g. a powered mattress, insulin monitor, pump, etc.) via a cable or other structure that communicatively couples to communication medium 100.

In some embodiments of person support apparatus 220, the control system integrated into person support apparatus also includes one or more of the previously described components of control system 74 that have been described with respect to person support apparatuses 20 and 120. For example, in some embodiments, person support apparatus 220 also includes one or more off-board transceivers 84 and one or more microphones 54. In these embodiments, person support apparatus 220 is able to cancel noises within quiet zone 60 that are detected by microphones 54 and for which no notification signal is received in advance, as well as both off-board and on-board noises where a notification signal is sent in advance of the noise.

As with person support apparatus 120, person support apparatus 220 may also be implemented with a head phone jack 90, one or more feedback microphones 56, a clock 92, an occupant detection subsystem 78, one or more alarms 82 that are directly controlled by controller 58, and one or more user interfaces 50 that may be used to configure and customize the cancellation of selected noises in any of the manners previously described.

Figure 7:
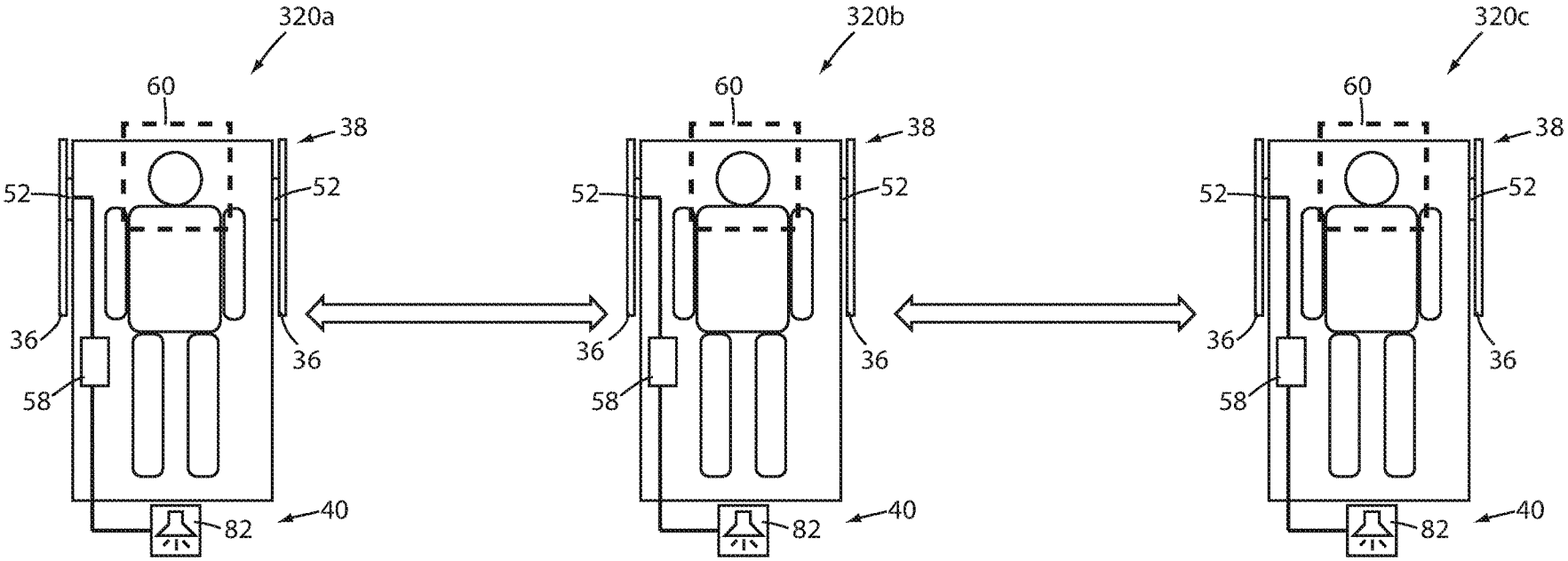
FIG. 7 is a block diagram of another person support apparatus according to still another embodiment of the disclosure.

FIG. 7 illustrates a set of person support apparatuses 320*a*, 320*b*, and 320*c* according to another embodiment of the present disclosure. Person support apparatuses 320 include a number of components that are the same as components of person support apparatuses 20, 120, and/or 220. Those components have been given the same reference number and, unless otherwise stated, operate in the same manner as previously described. Person support apparatuses 320 are also illustrated without one or more components of person support apparatuses 20, 120, and 220 (e.g. microphones 54). It will be understood that person support apparatuses 320 can be modified to include any of the components of person support apparatuses 20, 120, and/or 220 that are not shown in person support apparatuses 320 of FIG. 7. It will also be understood that person support apparatuses 320 can be modified to include any of the components and/or functions of control system 74 that are not explicitly described below as being incorporated into person support apparatuses 320.

Person support apparatuses 320 are configured to operate in any of the same manners described above with respect to person support apparatuses 20, 120, and/or 220 but with the added feature of forwarding one or more received notification signals to another person support apparatus, such as, but not limited to, any of person support apparatuses 20, 120, 220, and/or 320. For example, person support apparatus 320*a* is configured to receive a notification signal of an impending sound. The notification signal may be communicated to controller 58 of person support apparatus 320*a* either through off-board transceiver 84 or onboard transceiver 88. In response to that notification signal, not only does controller 58 take one or more of the actions previously described in order to cancel the upcoming sound within quiet zone 60 of person support apparatus 320*a*, but controller 58 also utilizes off-board transceiver 84 to send a notification signal to person support apparatus 320*b* regarding the upcoming sound. Thus, person support apparatus 320*a* is configured to receive a notification signal regarding an upcoming sound event, take action to cancel that sound within its own quiet zone 60, and also send one or more notification signals to surrounding person support apparatuses 320 (e.g. 320*b*) informing them of the upcoming sound event, thereby enabling the surrounding person support apparatuses 320 to actively cancel the sound from the upcoming sound event in their own respective quiet zones 60.

Person support apparatus 320*b* is configured with the same capabilities as person support apparatus 320*a*. Thus, when person support apparatus 320*b* receives the notification signal from person support apparatus 320*a* about the upcoming sound event, person support apparatus 320*b* takes action to actively cancel the sound event within its quiet zone 60 while also sending a notification signal to any other person support apparatuses 320 that are within its vicinity, such as person support apparatus 320*c*. Person support apparatus 320*c* may respond to this notification signal in the same manner and send another notification signal to yet another person support apparatus 320 (not shown).

In at least one embodiment, the notification signals between person support apparatuses 320 are communicated directly between each other (i.e. without using any intermediary device). In some such embodiments, the notification signal may be sent via ZigBee, Bluetooth, infrared, or other in other manners. In still other embodiments, the notification signal may be sent via one or more intermediaries, such as, but not limited to, one or more wireless access points, routers, or servers. In still other embodiments, at least one ultrasonic notification signal is included that is used by the person support apparatuses 320 to establish their relative acoustic positions with respect to the source of the upcoming sound event, thereby enabling the person support apparatuses 320 to determine the timing and synchronization necessary to effectively cancel the sound within their quiet zones 60. The ultrasonic notification signal may include, as noted, frequency modulation, amplitude modulation, phase modulation techniques, and/or other techniques for transmitting information about the upcoming sound event, including, but not limited to, the frequenc(ies) of the upcoming sound event, duration, intervals, the amplitude of the notification signal when transmitted, timing information for determining the propagation time for the upcoming sound event, etc.

Although person support apparatuses 320 have been described as forwarding notification signals that they receive to other person support apparatuses 320, it will be understood that person support apparatuses 320 are also configured to transmit notification signals about upcoming sound events that originate onboard person support apparatus 320 and for which they may not receive an off-board notification signal. In other words, controllers 58 of person support apparatuses 320 are configured to originate notification signals, not just forward notification signals received from other sources. For example, if controller 58 of person support apparatus 320*a* is going to activate an alarm 82, it is configured to send a notification signal to person support apparatus 320*b* prior to the activation of the alarm. The notification signal includes all the data regarding the upcoming alarm that person support apparatus 320*b* needs in order to effectively cancel the upcoming sound within its quiet zone 60. This generation of a notification signal to other person support apparatuses 320 may be incorporated into any of the person support apparatuses 20, 120, and/or 220 previously described. The notification signal can be transmitted electromagnetically and/or ultrasonically.

As with person support apparatuses 20, 120, and 220, person support apparatuses 320 may also be implemented with a head phone jack 90, one or more feedback microphones 56, a clock 92, an occupant detection subsystem 78, one or more alarms 82 that are directly controlled by controller 58, and one or more user interfaces 50 that may be used to configure and customize the cancellation of selected noises in any of the manners previously described.

Although the configuration and customization of which sounds to cancel and when to cancel the sounds has been described above primarily with respect to user interface 50, it will be understood such configuration may take place via a centralized server, or other structure, that communicates with each of the person support apparatuses via a connection to that server. For example, by utilizing a central server, all of the person support apparatuses within a healthcare facility (or portion of the healthcare facility) may be configured to cancel sounds in the same manner by inputting the configuration data into a single server, rather than having to manually walk to each person support apparatus 20 and configure the person support apparatus 20 individually using its respective user interface 50.

Additional modifications may be made to any of the person support apparatuses discussed herein beyond those explicitly described above. A non-exhaustive listing of these potential modifications includes the following: expanding the size of quiet zone 60 to include areas larger than person support apparatus 20, including areas large enough to encompass the entire room in which the person support apparatus is located; positioning one or more speakers 52 and/or controller 58 off board the person support apparatus; incorporating controller 58 and/or one or more speakers 52 into another medical device besides a person support apparatus; incorporating controller 58 and/or one or more speakers 52 into a headwall such as, but not limited to, the headwalls disclosed in commonly assigned U.S. patent application Ser. No. 14/819,844 filed Aug. 6, 2015, by inventors Krishna Bhimavarapu et al. and entitled PATIENT SUPPORT APPARATUSES WITH WIRELESS HEADWALL COMMUNICATION, the complete disclosure of which is incorporated herein by reference; positioning one or more of the speakers 52 and/or microphones 54 off board the person support apparatus, adding foam or other passive sound reducing components to person support apparatus 20; and/or other modifications.

In some modified embodiments, a person support apparatus is provided that is adapted to operate with conventional noise cancelling headphones. In this modified embodiment, the person support apparatus may or may not include any noise cancelling abilities of its own. When no such noise cancelling abilities of its own are provided, the patient wears conventional noise cancelling headphones which cancel out ambient noises. Regardless of whether or not the person support apparatus include noise cancelling abilities, the person support apparatus is configured to send one or more alarms to the headphone jack that are desirably heard by the patient. The particular alarms that are sent to the patient's noise cancelling headphone, as well as those that are not, can be selected by appropriate personnel. That is, the selection of which alarms to cancel is configurable by the user. In those instances where an alarm is desirably heard by the patient, the controller of the person support apparatus sends an audio signal to the head phone jack that matches the sound of the alarm. The alarm is also emitted aurally as a sound wave. Although the conventional noise-cancelling headphones will suppress this aurally emitted alarm sound wave, the same sound will be transmitted to the headphones through the head phone jack, thereby ensuring that the patient hears the alarm. In this manner, authorized personnel retain control over which sounds a patient hears and doesn't hear, even when the patient is wearing conventional noise cancellation headphones. In some of these embodiments, the person support apparatus includes a control that is selected when the patient is wearing noise-cancelling headphones. When selected, the person support apparatus sends alarm sounds to the head phone jacks for alarms that are desirably heard by the patient. When not selected, the person support apparatus does not send the alarm sound to the head phone jack.

In still other embodiments, person support apparatus 20, 120, 220, and/or 320 is modified to determine and generate an acoustic map of the room in which the person support apparatus is positioned. The acoustic map is obtained by communicating with one or more devices in the room and instructing them to emit, at specific times, ultrasonic signals, such as, but not limited to, 25 kHz sound waves. The person support apparatus then measures the delay between the time the signals are emitted as sound waves and the time they are detected by the person support apparatus, as well as the amount of attenuation the ultrasonic sound waves experience. This information is gathered from all of the devices within the room that the person support apparatus is in communication with, thereby resulting in an acoustic map of the delays and attenuations associated with each sound emitting device in the room relative to the person support apparatus. This information is then used in any of the manners described above to cancel future alarms from these devices. In some of these embodiments, the acoustic map may be generated partially or wholly using audible sound waves, rather than ultrasonic signals. When using the audible signals, the generation of the acoustic map may be undertaken when no one is positioned within the room. The absence of people in the room may be determined in multiple manners, including, but not limited to, using the video camera system disclosed in commonly assigned U.S. patent application Ser. No. 14/578,630 filed Dec. 22, 2014, by inventors Richard Derenne et al. and entitled VIDEO MONITORING SYSTEM, the complete disclosure of which is incorporated herein by reference.

Various additional alterations and changes beyond those already mentioned herein can be made to the above-described embodiments. This disclosure is presented for illustrative purposes and should not be interpreted as an exhaustive description of all embodiments or to limit the scope of the claims to the specific elements illustrated or described in connection with these embodiments. For example, and without limitation, any individual element(s) of the described embodiments may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Any reference to claim elements in the singular, for example, using the articles "a," "an," "the" or "said," is not to be construed as limiting the element to the singular.

What is claimed is:

1. A person support apparatus comprising:

a support surface configured to support thereon an occupant of the person support apparatus;

a receiver configured to receive a notification signal from a first device regarding a future noise sound wave to be emitted by a sound emitting component, the notification signal including information indicating at least one of the following: a pitch of the future noise sound wave, a duration of the future noise sound wave, a length of a time interval between repetitions of the future noise sound wave, a start time of the future noise sound wave, synchronization data regarding the future noise sound wave, or a phase of the future noise sound wave; and an active noise cancellation device configured to generate a noise cancelling sound wave to cancel the future noise sound wave, the active noise cancellation device using the information included in the notification signal to generate the noise cancelling sound wave.

2. The person support apparatus of claim 1 wherein the notification signal includes information indicating at least three of the following: a pitch of the future noise sound wave, a duration of the future noise sound wave, a length of a time interval between repetitions of the future noise sound wave, a start time of the future noise sound wave, synchronization data regarding the future noise sound wave, or a phase of the future noise sound wave.

3. The person support apparatus of claim 2 wherein the first device is another person support apparatus spaced from the person support apparatus.

4. The person support apparatus of claim 2 wherein the receiver is an ultrasonic receiver configured to detect ultrasonic sound waves.

5. The person support apparatus of claim 2 further including an occupant detection subsystem configured to detect a presence or absence of an occupant in the person support apparatus, wherein the active noise cancellation device does not generate the noise cancelling sound wave if the occupant detection subsystem determines that the person support apparatus is unoccupied.

6. The person support apparatus of claim 2 further including a memory in which pitch information regarding the future noise sound wave is stored, and wherein the notification signal does not include information indicating a pitch of the future noise sound wave, and wherein the active noise cancellation device generates the noise cancelling sound wave based upon the pitch information stored in the memory.

7. The person support apparatus of claim 2 wherein the active noise cancellation device includes a first speaker positioned adjacent a right side of a head end of the person support apparatus and a second speaker positioned adjacent a left side of the head end, the active noise cancellation device configured to use the first and second speakers to generate the noise cancelling sound wave, and the noise cancelling sound wave is adapted to cancel the future noise sound wave in a region adjacent the head end of the support surface.

8. The person support apparatus of claim 2 further including a headphone jack configured to receive a set of headphones, wherein the active noise cancellation device generates the noise cancelling sound wave in the set of headphones when the set of headphones are plugged into the headphone jack.

9. The person support apparatus of claim 1 further comprising an onboard Controller Area Network, wherein the first device is a first node on the Controller Area Network, and the sound emitting component is a motor onboard the person support apparatus.

10. The person support apparatus of claim 1 further comprising an onboard Controller Area Network, wherein the first device is a first node on the Controller Area Network, and the sound emitting component is an alarm onboard the person support apparatus.

11. The person support apparatus of claim 1 further comprising:

a microphone configured to detect an ambient sound wave; and wherein the active noise cancellation device is further configured to generate an ambient noise cancelling sound wave to cancel the ambient sound wave.

12. The person support apparatus of claim 1 further comprising:

a microphone configured to detect an ambient sound wave; and a controller;

wherein the active noise cancellation device is further configured to generate an ambient sound cancelling wave configured to cancel the ambient sound wave; and wherein the controller configured to perform the following: (i) to control whether or not the active noise cancellation device generates the ambient sound cancelling wave, (ii) to analyze characteristics of the ambient sound wave in order to determine if the ambient sound wave is associated with at least one of the following alarms: a fire alarm, a smoke alarm, a person support apparatus alarm, or a weather emergency alarm; and (iii) to control the active noise cancellation device so as to not generate the ambient sound cancelling wave if the ambient sound wave is associated with at least one of the aforementioned alarms.

13. The person support apparatus of claim 12 wherein the active noise cancellation device includes a first speaker positioned adjacent a right side of a head end of the person support apparatus and a second speaker positioned adjacent a left side of the head end, the active noise cancellation device configured to use the first and second speakers to generate the ambient sound cancelling wave, and the ambient sound cancelling wave is adapted to cancel the ambient sound wave in a region adjacent the head end of the support surface.

14. The person support apparatus of claim 13 further including an occupant detection subsystem configured to detect a presence or absence of an occupant in the person support apparatus, wherein the active noise cancellation device does not generate the ambient sound cancelling wave if the occupant detection subsystem determines that the person support apparatus is unoccupied.

15. The person support apparatus of claim 12 further including a headphone jack configured to receive a set of headphones, wherein the active noise cancellation device is adapted to generate the ambient sound cancelling wave in the set of headphones when the set of headphones are plugged into the headphone jack.

16. The person support apparatus of claim 15 wherein the notification signal includes information indicating at least three of the following: a pitch of the future noise sound wave, a duration of the future noise sound wave, a length of a time interval between repetitions of the future noise sound wave, a start time of the future noise sound wave, synchronization data regarding the future noise sound wave, or a phase of the future noise sound wave.

17. The person support apparatus of claim 16 wherein the first device is another person support apparatus spaced from the person support apparatus.

18. The person support apparatus of claim 16 further including a memory in which pitch information regarding the future noise sound wave is stored, and wherein the notification signal does not include information indicating a pitch of the future noise sound wave, and wherein the active noise cancellation device generates the noise cancelling sound wave based upon the pitch information stored in the memory.

19. The person support apparatus of claim 16 further comprising an onboard Controller Area Network, wherein the first device is a first node on the Controller Area Network, and the sound emitting component is one of a motor onboard the person support apparatus or an alarm onboard the person support apparatus.

* * * * *